US008501295B2

(12) United States Patent
Sweeney et al.

(10) Patent No.: US 8,501,295 B2
(45) Date of Patent: Aug. 6, 2013

(54) WALL DROP PAINT BARRIER PROTECTOR

(75) Inventors: Danny Sweeney, Apex, NC (US); Michael Sherman, Mooresville, NC (US); James Dale, London, KY (US); William Lane Ball, Statesville, NC (US); Scott Pyle, Braselton, GA (US)

(73) Assignee: Zibra, LLC, Mooresville, NC (US)

( * ) Notice: Subject to any disclaimer, the term of this patent is extended or adjusted under 35 U.S.C. 154(b) by 400 days.

(21) Appl. No.: 12/951,038

(22) Filed: Nov. 20, 2010

(65) Prior Publication Data

US 2011/0131890 A1 Jun. 9, 2011

Related U.S. Application Data

(63) Continuation-in-part of application No. 12/950,993, filed on Nov. 19, 2010, now abandoned, which is a continuation-in-part of application No. 12/950,998, filed on Nov. 19, 2010, now abandoned.

(60) Provisional application No. 61/283,467, filed on Dec. 4, 2009.

(51) Int. Cl.
*E04G 21/24* (2006.01)

(52) U.S. Cl.
USPC ..... 428/77; 52/3; 428/55

(58) Field of Classification Search
USPC ..... 428/77, 55; 52/3
See application file for complete search history.

(56) References Cited

U.S. PATENT DOCUMENTS

| | | | | |
|---|---|---|---|---|
| 4,822,669 | A | 4/1989 | Roga | |
| 5,173,346 | A | 12/1992 | Middleton | |
| 5,266,390 | A | 11/1993 | Garland | |
| 5,500,267 | A | 3/1996 | Canning | |
| 5,761,853 | A | 6/1998 | Trosper et al. | |
| 5,816,305 | A | 10/1998 | May | |
| 5,930,956 | A | 8/1999 | Trosper et al. | |
| 6,640,501 | B1 | 11/2003 | Hussey | |
| 6,815,036 | B1 | 11/2004 | Romero | |
| 6,911,407 | B2 | 6/2005 | Sherrod et al. | |
| 7,691,465 | B2 | 4/2010 | Bukovitz et al. | |
| 8,334,041 | B2 | 12/2012 | Sweeney et al. | |
| 2003/0196387 | A1 * | 10/2003 | Hussey | 52/3 |

(Continued)

OTHER PUBLICATIONS

Information Disclosure Statement (IDS) Letter Regarding Common Patent Application(s), dated Dec. 13, 2010.

(Continued)

*Primary Examiner* — Brent O'Hern
(74) *Attorney, Agent, or Firm* — Tillman Wright, PLLC; Chad D. Tillman; Jeremy C. Doerre

(57) ABSTRACT

A drop cloth includes: a sheet of material having a length that is greater than its width; and a series of panels, each panel being connected to the sheet in series along the length of the sheet. The length may be substantially greater than the width. The panels are generally identical to one another and are equally spaced along the length of the sheet such that the spacing is sufficient for the sheet to be folded in-between adjacent panels such that the panes are stacked, the spacing between adjacent panels being about twice the thickness of each panel. The drop cloth can be used for protection against drips and spills when painting along a wall of a room.

20 Claims, 2 Drawing Sheets

(56) References Cited

U.S. PATENT DOCUMENTS

| | | | | |
|---|---|---|---|---|
| 2005/0058803 | A1 | 3/2005 | Bowden | |
| 2005/0262781 | A1 | 12/2005 | Hughes | |
| 2008/0066389 | A1 * | 3/2008 | Siegel | 52/3 |
| 2008/0066420 | A1 | 3/2008 | May | |
| 2010/0201046 | A1 | 8/2010 | Orlych et al. | |

OTHER PUBLICATIONS

Information Disclosure Statement (IDS) Letter Regarding Common Patent Application(s), dated Nov. 15, 2012.
Information Disclosure Statement (IDS) Letter Regarding Common Patent Application(s), dated Oct. 16, 2012.

* cited by examiner

WALL DROP PAINT BARRIER PROTECTOR

CROSS-REFERENCE TO RELATED APPLICATION

The present application is a U.S. continuation-in-part patent application of, and claims priority under 35 U.S.C. §120 to, U.S. patent application Ser. No. 12/950,993, filed Nov. 19, 2010, now abandoned, which '993 application and any publication thereof and any patent issuing therefrom are incorporated herein by reference, and which '993 application is a U.S. nonprovisional patent application of, and claims priority under 35 U.S.C. §119(e) to, U.S. provisional patent application Ser. No. 61/283,467, filed Dec. 4, 2009, which '467 provisional patent application is incorporated by reference herein; and the present application is a U.S. continuation-in-part patent application of, and claims priority under 35 U.S.C. §120 to, U.S. patent application Ser. No. 12/950,998, filed Nov. 19, 2010, now abandoned, incorporated herein by reference, which '998 application and any publication thereof and any patent issuing therefrom are incorporated herein by reference, and which '998 application is a U.S. nonprovisional patent application of, and claims priority under 35 U.S.C. §119(e) to, U.S. provisional patent application Ser. No. 61/283,467, filed Dec. 4, 2009, which '467 provisional patent application is incorporated by reference herein. The disclosure of the '467 application is contained within the Appendix, which is incorporated herein by reference. The Appendix further includes disclosure of additional paint barrier protectors, which is incorporated herein by reference.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to paint barrier protectors (sometimes referred to as drip barriers), and more specifically to new and improved paint barrier protectors for floors adjacent walls in rooms.

There are a variety of paint barrier protectors. Perhaps the most commonly known and used are drop cloths. A conventional drop cloth typically consists of a large cloth that is laid over a floor, stairs, or a piece of furniture while a room is being painted, and is typically made from one of three different materials, i.e., canvas, paper, and plastic. Drop clothes made from each of these three materials provide differing benefits when used. Generally paper and plastic drop cloths are disposable, single-use apparatus, and are the least absorbent in comparison to canvas drop cloths. Canvas drop cloths are reuseable, and are the most absorbent of the three materials, but must be cleaned periodically and thus require maintenance.

Such drop cloths have common deficiencies. For one, they require what seems an inordinate amount of time to setup for use when preparing a room for painting. They similarly seem to require an inordinate amount of time to reposition during painting, and an inordinate amount of time to remove and fold up when the painting is finished. Typical drop cloths used today also do not have rigid straight edges, which is desirable for placing the drop cloths against walls and trim board. Typical drop cloths also are somewhat dangerous in that, when stepped upon, they are prone to slipping on hardwood floor, tile floors, and other flooring.

One or more embodiments of the present invention (but not necessarily all embodiments) address one or more of these aforementioned disadvantages of conventional drop cloths in common use.

SUMMARY OF THE INVENTION

The present invention includes many aspects and features. Moreover, while many aspects and features relate to, and are described in, the context of painting, the present invention is not limited to use only in painting, as will become apparent from the following summaries and detailed descriptions of aspects, features, and one or more embodiments of the present invention. For example, the present invention may be used during other forms of home improvement, wherein it is desired to protect a flooring with a covering.

In an aspect of the invention, a drop cloth includes: a sheet of material having a length greater than its width; and a series of panels, each panel being connected to sheet along the length of the sheet. The length may be substantially greater than its width.

In a feature, the panels are generally identical to one another and are equally spaced along the length of the sheet such that the spacing is sufficient for the sheet to be folded in-between adjacent panels such that the panes are stacked, the spacing between adjacent panels being about twice the thickness of each panel.

In another feature, each panel is sewn to an underside of the sheet and is exposed on the underside of the sheet.

In another feature, each panel is adhered to an underside of the sheet and is exposed on the underside of the sheet.

In another feature, the series of panels consist of four panels.

In another feature, the series of panels consist of an even number of panels.

In another feature, each panel consists of an EVA (Ethylene vinyl acetate) material.

In another feature, each panel is hard.

In another feature, each panel has the same rigidity, height, width, and thickness as each of the other panels of the series.

In another feature, each panel is at least semirigid.

In another feature, outer edges of the two end panels extend along and in proximity to opposite transverse end edges of the sheet so as to define rigid transverse ends of the drop cloth.

In another feature, a small extent of the lengthwise edge portions of the sheet are folded back over themselves and over the opposite transverse end edges of each panel, whereat each panel is sewn to the lengthwise edge portions of the sheet.

In another feature, each panel is sewn along its lengthwise edge portions to the sheet.

In another feature, the sheet comprises a combination of a nonwoven material and PE (polyethene) film.

In another feature, the sheet comprises a nonwoven fabric that defines the topside of the drop cloth, and wherein a thermo bonded poly undercoat of the nonwoven fabric provides a leak-proof barrier of the sheet.

In another feature, a bottom side of each panel predominantly is exposed and provides resistance to sliding or slipping on hardwood floors and tile surfaces.

In another feature, the rigidity of each panel is sufficient such that the drop cloth has a generally rigid straight edge for abutting against a floor board in a linear and snug manner for protecting a hardwood floor or a tile surface against paint drips and spills.

In another feature, the rigidity of each panel is sufficient such that the drop cloth can be positioned and repositioned with one's foot by kicking and sliding it into position.

Other aspects include the making of a drop cloth in accordance with one or more aspects or features (including the aspects and features of the incorporated references), and the use of a drop cloth in accordance with one or more aspects or features (including the aspects and features of the incorporated references).

In addition to the aforementioned aspects and features of the present invention, it should be noted that the present invention further encompasses the various possible combinations and subcombinations of such aspects and features. Thus, for example, any aspect may be combined with an aforementioned feature in accordance with the present invention without requiring any other aspect or feature.

BRIEF DESCRIPTION OF THE DRAWINGS

One or more preferred embodiments of the present invention now will be described in detail with reference to the accompanying drawings, wherein the same elements are referred to with the same reference numerals, and wherein.

DETAILED DESCRIPTION

Figure 1:
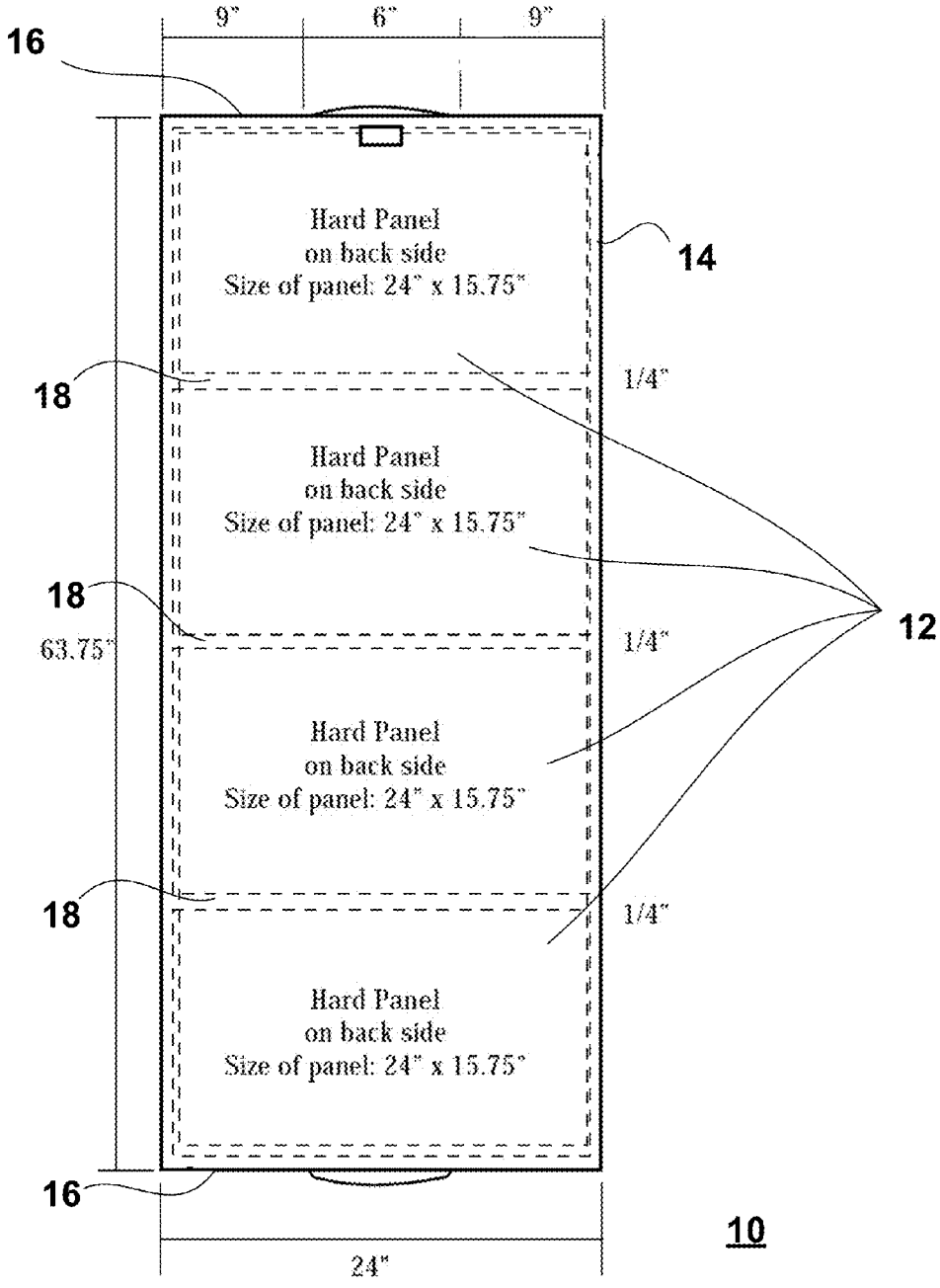
FIG. 1 is a schematic plan view of a topside of a preferred embodiment of a wall drop paint barrier protector when in a fully unfolded or extended configuration, in accordance with one or more aspects of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶16, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

Turning now to the drawings, FIG. 1 is a schematic plan view of a topside of a preferred embodiment 10 of a wall drop paint barrier protector when in a fully unfolded or extended configuration, in accordance with one or more aspects of the present invention. Similarly, FIG. 2 is a schematic plan view of another preferred embodiment 10' of a wall drop paint barrier protector when in a fully unfolded or extended configuration, in accordance with one or more aspects of the present invention.

Figure 2:
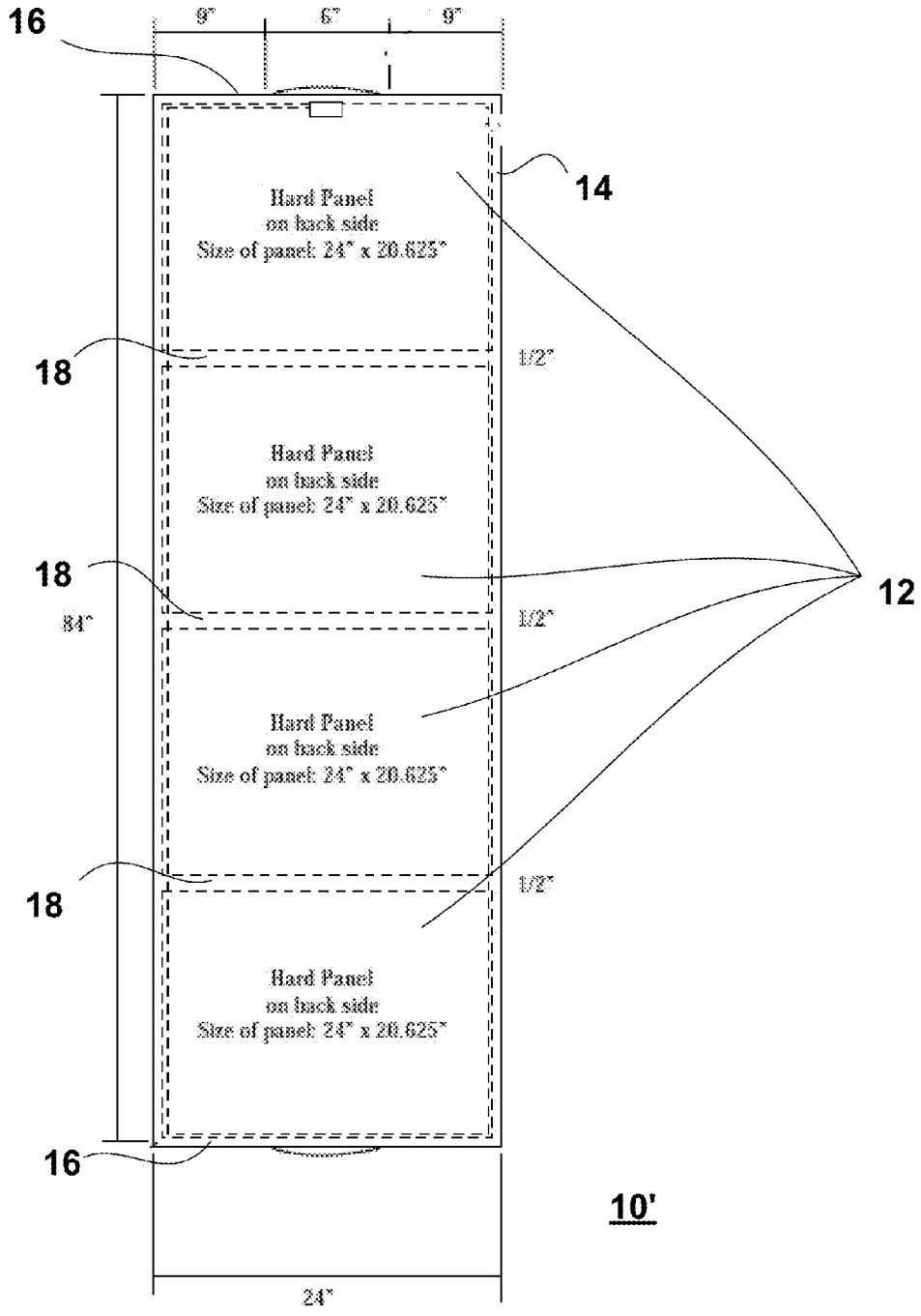
FIG. 2 is a schematic plan view of a topside of another preferred embodiment of a wall drop paint barrier protector when in a fully unfolded or extended configuration, in accordance with one or more aspects of the present invention.

As shown in FIGS. 1 and 2, each preferred wall drop paint barrier protector (hereinafter referred to generally as a "drop cloth") includes a series of panels 12, each connected to or otherwise attached to a length of material or sheet 14. Each panel is shown in FIGS. 1 and 2 as being sewn to a respective sheet with double stitched hems, but alternatively one or more of the panels may be adhered to a respective sheet instead, or both adhered and sewn.

More particularly, the drop cloth includes a series of four panels that are at least semirigid, and with regard to the preferred embodiment of FIG. 1, have a thickness of about 1 mm, and with regard to the preferred embodiment of FIG. 2, have thickness of about 5 mm, as indicated in FIG. 2.

Preferably, each panel is relatively "hard" and preferably comprises an EVA material. Additionally, the panels preferably include the dimensions indicated in FIGS. 1 and 2, respectively.

The sheet and panels in each of these preferred embodiments are sewn together in a manner that creates fabric hinges or gaps 18 between the structural panels so as to allow the drop cloth to fold in the areas between the panels. Outer edges of the two end panels 16 preferably extend along and in proximity to the opposite transverse end edges of the sheet, whereby rigid transverse ends of the drop cloth are created.

A small extent of the lengthwise edge portions of the sheet are folded back over themselves and over the opposite transverse end edges of each panel, whereat each panel is sewn to the lengthwise edge portions of the sheet. Each panel further preferably is sewn along its lengthwise edge portions to the sheet.

The sheet preferably has a PMS 109 Yellow color, and preferably comprises a combination of a nonwoven material (90 gram) and a PE backer (30 gram) to the nonwoven material. A nonwoven fabric preferably is used because of the absorbency and wickability characteristics, which are believed to be better than those of a canvas. The sheet preferably comprises a nonwoven fabric material that defines the topside of the drop cloth having a thermo bonded poly undercoat providing a leak-proof barrier. The sheet thereby preferably provides a leak-proof barrier for paint, water, and other liquids that may be used and against spills and drips of which protection is sought. A logo may be screen printed on the sheet, as shown in the drawings.

Each panel preferably is of the same length, width and thickness as the other panels in a particular embodiment. Each panel also preferably has a similar structural integrity and rigidity to that of each other of the panel. Being attached or adhered to the sheet, each panel is covered thereby predominantly on a top side thereof. The bottom side of each panel predominantly is exposed and preferably provides resistance to sliding or slipping on hardwood floors and tile surfaces. The material of the panel also preferably is a non-marking material so that the hardwood floors and tile surfaces are not marred by use of the drop cloth.

Furthermore, the rigidity is sufficient that the joining of the panels with the sheet results in a fixed and continuous assembly having a generally fixed, straight edge for abutting against a floor board in a linear and snug manner for protecting the hardwood floor, and tile surface against paint drips and spills. It is believed that use of the straight edge provided thereby eliminates the need to use painters or masking tape to affix the drop cloth to the floor board or to the wall that the drop abuts. The drop cloth can simply be repositioned with one's foot by kicking and sliding it into position.

Each panel also preferably is rectangular. However, it is contemplated that panels could be arranged in other patterns, as well. Exemplary patterns that might be used are shown attached to a sheet in FIG. 16, which is a photograph of a perspective view of a backside of a demo stair drop paint barrier protector when in a fully unfolded configuration and positioned on a floor. It will be appreciated that a variety of different patterns of panels are shown, and that any one pattern of which (or any combination of which) could be used in a series with a sheet for making a wall drop paint barrier protector.

A handle preferably is included at opposite transverse ends of the sheet for ease of carrying the drop cloth. The handles of each of the preferred embodiments of FIGS. 1 and 2 has a length of about 7 inches and is made out of a nonwoven material. Such a handle may be sewn to the sheet, an end panel, or both. Exemplary such handles are shown in the drawings.

With further consideration to preferred drop cloths, the spacing between adjacent panels preferably is no more than twice the thickness of a panel. In particular, the spacing should be sufficient to allow the panels to be stacked on top of each other in alignment with each other (the sides being aligned with edges extending in parallel). Preferably, the spacing is not more than what is sufficient to achieve this folding.

The drop cloth can be easily repositioned on a floor to cover a new area simply by kicking and sliding with one's foot as a result of the rigidity provided by the panels and the minimal spacing provided between the panels.

It further will be appreciated that the drop cloth can be reconfigured such that some, but not all, of the panels are arranged in a stacked pattern or configuration, whereby the overall length of the drop cloth is adjustable.

Turning now to U.S. Patent Application Publication No. 2011/0131890 A1 which is incorporated herein by reference and which represents the publication of the present application. FIGS. 3-15 thereof are photographs of actual prototypes of the invention that have been reduced to practice. In particular, FIG. 3 of this publication is a photograph of a perspective view of a top side of a prototype wall drop paint barrier protector when in a fully folded configuration on top of a carpeted floor, in accordance with one or more aspects of the present invention; FIG. 4 of this publication is a photograph of a perspective view a top side of the prototype wall drop paint barrier protector of FIG. 3 of this publication when in the fully unfolded configuration; FIG. 5 of this publication is a photograph of a perspective view of a backside of the prototype wall drop paint barrier protector of FIG. 4 of this publication when in the fully unfolded configuration; FIG. 6 of this publication is a photograph of a close-up of an area of the top side of the prototype wall drop paint barrier protector shown in FIG. 5 of this publication; FIG. 7 of this publication is a photograph of a close-up of an area of the backside of the prototype wall drop paint barrier protector shown in FIG. 5 of this publication; FIG. 8 of this publication is a photograph of a perspective view of a top side of the prototype wall drop paint barrier protector when in a fully unfolded configuration and positioned adjacent a wall in a room, in accordance with one or more aspects of the present invention; FIG. 9 of this publication is a photograph of a perspective view of a top side of another prototype wall drop paint barrier protector when in a fully unfolded configuration on a hardwood floor, in accordance with one or more aspects of the present invention; FIG. 10 of this publication is a photograph of a perspective view of a backside of a portion of the prototype wall drop paint barrier protector of FIG. 9 of this publication when in a fully unfolded configuration on a hardwood floor; FIG. 11 of this publication is a photograph of a close-up of an edge of an EVA panel on the backside of the prototype wall drop paint barrier protector shown in FIG. 10 of this publication; FIG. 12 of this publication is a photograph of a side perspective view of another prototype wall drop paint barrier protector when in a partially folded W-shaped configuration, in accordance with one or more aspects of the present invention; FIG. 13 of this publication is a photograph of a side elevational view of another prototype wall drop paint barrier protector when in a completely folded configuration and being held by a person's arm via handles of the wall droppaint barrier protector; FIG. 14 of this publication is a photograph of a perspective view of the top side of another prototype wall drop paint barrier protector when in a fully unfolded configuration and positioned on a hardwood floor adjacent a wall in a room, wherein the panels are constructed from a foam material; and FIG. 15 of this publication is a photograph of a perspective view of the prototype wall drop paint barrier protector of FIG. 14 of this publication illustrating the flexibility of foam material forming the panels in this particular prototype.

With continuing reference to this publication, FIGS. 3-8 pertain to a first prototype 100, which includes a series of panels 112 sewn at transverse edges thereof and at end edges thereof to sheet 114, with fabric hinges 118 extending therebetween. Moreover, as shown in FIG. 6 of this publication, the end edges of the panels are sewn at 113 to overlapping portions of sheet 114. FIGS. 9-11 of this publication illustrate another prototype; FIG. 12 of this publication illustrates another prototype; and FIG. 13 of this publication illustrates another prototype, all of which are generally similar to the prototype 100. The prototype of FIGS. 14 and 15 of this publication, on the other hand, includes foam panels that are flexible (as shown in FIG. 15 of this publication) but that still depart sufficient rigidity to the overall drop cloth so as to give it a clean edge and enable positioning of it through kicking and sliding of the drop cloth. The foam panels each are bounded by strips of EVA material that is sewn to the sheet.

In addition to the foregoing. FIG. 16 of this publication is a photograph of a perspective view of a backside of a demo stair drop paint barrier protector when in a fully unfolded configuration and positioned on a floor, wherein various different patterns of panels are shown, any one pattern of which (or any combination of which) could be used in a series with a sheet for making a wall drop paint barrier protector in accordance with the present invention.

Additional Paint Barrier Protectors

Additional paint barrier protectors are disclosed in the Appendix attached hereto and incorporated by reference herein. Many of these additional embodiments include this basic design of the aforementioned embodiments, which combines a series of structural panels and fabric in various sized drop cloths for specific uses. Indeed, one of these embodiments uses a structural panel material in a manner replicating the sole of a shoe and where the fabric is attached to the panel creating a sock like upper that uses an elastic band or a drawstring top. In this design, the shoe and sock like product are placed on the feet of extension and step ladders to prevent the floors from being scratched. The elastic banding or drawstring keeps the material snugly in place around the ladder feet until removed by the user. The additionally disclosed embodiments include drop cloths comprising specialized patterns that speed the setup and use in the painting of door jams, columns, and in bathrooms around toilets. These drop cloths are desirably made of the same nonwoven material and panel material as described above and may be of thicker material stock. In one of the additional embodiments, a unique pattern is designed so that one or two drop cloths may be used in tandem for multiple special applications, such as on door jams or columns. The design pattern on one side of the drop cloth is sewn to create a notch in the approximate center of a u-shape cutout, which is ideal for fitting snugly up against door jamb trim. On the opposite side of the material is an L-shape cutout that can be combined with a partner template to custom fit the patterned drop cloth around varying sizes of columns with ease. In another embodiment, two material shapes are sewn together as one in a sized specified so as to fit over the tank of a toilet and the seat of the toilet for protecting the toilet from being dripped on when painting in bathrooms.

From the foregoing, it will be appreciated that drop cloths of the present invention provide improved protection and safety over conventional drop cloths commonly used today. Furthermore, based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

For example, the EVA material provides rigidity, non-slip gripping, is light in weight, and is therefore preferred in the embodiment described with reference to the drawings herein. However, it is contemplated that, while not preferred, a range of other materials with similar characteristics to that of EVA may be used to create the structural panels used in accordance with embodiments of the invention. Such other materials include rubber, foam, or paper board.

Additionally, the fabric material in the embodiment described with reference to the drawings herein preferably is a non-woven, engineered fabric and is adhered to the structural panels by stitching. However, it is contemplated that the material can be a cloth material, such as a canvas, and that the panels can be adhered to the material by adhesive glue, or both glue and stitching.

Furthermore, in the embodiment described with reference to the drawings herein, the fabric is sewn onto predominantly one side (i.e., the top side) of the structural panels in a manner that creates a fabric hinge or gap between the structural panels so as to allow the panels to fold onto one another like a book cover. It is additionally contemplated that fabric may also be wrapped and sewn to the underside edge of the structural panels. The engineered fabric is desired for its strength, durability, and balance of drip absorption and repellency. The panels at opposite end desirably have handles attached at each end for portability when folded. One or more embodiments of the invention also could include pockets or straps sewn onto the drop cloth for the carrying of common paint tools or other utensils.

In yet another variation of embodiments of the present invention, panels of a drop cloth, rather than being sewn to the sheet of fabric, are inserted and sewn or glued between two sheets.

What is claimed is:

1. A drop cloth, comprising:

(a) a sheet of material having a length greater than its width; and (b) a series of panels, each panel being connected to the sheet in series along the length of the sheet;

(c) wherein the panels are generally identical to one another and are equally spaced along the length of the sheet such that the spacing is sufficient for the sheet to be folded in-between adjacent panels such that the panels are stacked; and (d) wherein the spacing between adjacent panels is about twice the thickness of a panel.

2. The drop cloth of claim 1, wherein each panel consists of an ethylene vinyl acetate material.

3. The drop cloth of claim 1, wherein the series of panels consist of an even number of panels.

4. The drop cloth of claim 1, wherein the length of the sheet is about six feet to eight feet; wherein the width is no less than about twelve inches and no more than about thirty-six inches; and wherein the thickness is about two mm to five mm.

5. The drop cloth of claim 1, wherein outer edges of two end panels extend along and in proximity to opposite transverse end edges of the sheet so as to define transverse ends of the drop cloth each comprising a straight side edge.

6. The drop cloth of claim 1, wherein an extent of lengthwise edge portions of the sheet are folded back over themselves and over opposite transverse end edges of each panel, whereat each panel is sewn to the lengthwise edge portions of the sheet.

7. The drop cloth of claim 1, wherein each panel is sewn along lengthwise edge portions to the sheet.

8. The drop cloth of claim 1, wherein the sheet comprises a combination of a nonwoven material and polyethylene material.

9. The drop cloth of claim 1, wherein the sheet comprises a nonwoven fabric that defines the topside of the drop cloth, and wherein a thermo bonded poly undercoat of the nonwoven fabric provides a leak-proof barrier of the sheet.

10. The drop cloth of claim 1, wherein a bottom side of each panel predominantly is exposed and provides resistance to sliding or slipping on hardwood floors and tile surfaces.

11. The drop cloth of claim 1, wherein the rigidity of each panel is sufficient such that the drop cloth has a generally rigid straight edge for abutting against a floor board in a linear and snug manner for protecting the hardwood floor and tile surface against paint drips and spills.

12. The drop cloth of claim 1, wherein the rigidity of each panel is sufficient such that the drop cloth can be repositioned with one's foot by kicking and sliding it into position.

13. The drop cloth of claim 1, wherein the sheet is foldable between adjacent panels like a book cover such that the panels can be arranged in a stacked pattern, each in alignment with and extending either under or over each other panel.

14. A drop cloth, comprising:

(a) a sheet of material having a length greater than its width; and (b) a series of panels, each panel being connected to the sheet in series along the length of the sheet;

(c) wherein the panels are generally identical to one another and spaced along the length of the sheet such that the spacing is sufficient for the sheet to be folded in-between adjacent panels for stacking of the panels, the spacing between adjacent panels not exceeding about twice the thickness of a panel.

15. A drop cloth, comprising:

(a) a sheet of material having a length greater than its width, the width of the sheet being no less than about twelve inches and no more than about thirty-six inches; and (b) a series of panels, each panel being connected to the sheet in series along the length of the sheet and each panel generally extending the width of the sheet;

(c) wherein adjacent panels of the series are spaced about one-quarter of an inch to one-half of an inch between each other along the length of the sheet, with the sheet being foldable in-between adjacent panels for stacking of the panels.

16. The drop cloth of claim 15, wherein the length of each panel is about 15.75 inches.

17. The drop cloth of claim 15, wherein the length of each panel is about 20.625 inches.

18. The drop cloth of claim 15, wherein the width of each panel is about 24 inches.

19. The drop cloth of claim 15, wherein the length of the sheet is about six feet to eight feet.

20. The drop cloth of claim 15, wherein outer edges of two end panels extend along and in proximity to opposite transverse end edges of the sheet, and wherein lengthwise edge portions of the sheet are folded over opposite transverse end edges of each panel.

* * * * *